US010107246B2

(12) United States Patent
Hofmann et al.

(10) Patent No.: US 10,107,246 B2
(45) Date of Patent: Oct. 23, 2018

(54) NOZZLE ASSEMBLY FOR A FLUID INJECTOR AND FLUID INJECTOR

(71) Applicant: Continental Automotive GmbH, Hannover (DE)

(72) Inventors: Thomas Hofmann, Obertraubling (DE); Alexander Brandl, Regensburg (DE); Michael Engl, Rettenbach (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 271 days.

(21) Appl. No.: 14/432,555

(22) PCT Filed: Sep. 25, 2013

(86) PCT No.: PCT/EP2013/069988

§ 371 (c)(1),
(2) Date: Mar. 31, 2015

(87) PCT Pub. No.: WO2014/053375

PCT Pub. Date: Apr. 10, 2014

(65) Prior Publication Data

US 2015/0240770 A1 Aug. 27, 2015

(30) Foreign Application Priority Data

Oct. 2, 2012 (DE) ..... 10 2012 217 991

(51) Int. Cl.
*F02M 61/10* (2006.01)
*F02M 61/18* (2006.01)
*F02M 61/16* (2006.01)

(52) U.S. Cl.
CPC ..... *F02M 61/10* (2013.01); *F02M 61/168* (2013.01); *F02M 61/18* (2013.01); *F02M 2200/03* (2013.01)

(58) Field of Classification Search
CPC ..... F02M 61/168; F02M 61/10; F02M 61/18; F02M 2200/03

(Continued)

(56) References Cited

U.S. PATENT DOCUMENTS 2,886,023 A * 5/1959 Holley et al. ..... F02M 59/00 123/382
2,916,028 A * 12/1959 Mansfield ..... F02M 57/025 123/447

(Continued)

FOREIGN PATENT DOCUMENTS

DE 10018663 A1 10/2001 ..... F02M 61/04
DE 10115325 A1 10/2002 ..... F02M 61/16

(Continued)

OTHER PUBLICATIONS

Chinese Office Action, Application No. 201380051812.2, 14 pages, dated Aug. 1, 2016.

(Continued)

*Primary Examiner* — Chee-Chong Lee
(74) *Attorney, Agent, or Firm* — Slayden Grubert Beard PLLC

(57) ABSTRACT

A nozzle assembly for a fluid injector includes a nozzle body with a central axis, the nozzle body having a nozzle body recess, at least one injection opening and an outer wall facing away from the nozzle body recess. The nozzle assembly further includes a nozzle tension nut for coupling the nozzle body to an injector body, the nozzle tension nut having an inner wall facing the outer wall of the nozzle body. The nozzle body and the nozzle tension nut are formed such that, under the effect of an operational pressure exerted in ordinary operation by a metered fluid onto the nozzle body (Continued)

recess, the outer wall of the nozzle body rests, at least in part, against the inner wall of the nozzle tension nut in the radial direction.

6 Claims, 4 Drawing Sheets

(58) Field of Classification Search
USPC ..... 239/600
See application file for complete search history.

(56) References Cited

U.S. PATENT DOCUMENTS 3,505,984 A * 4/1970 Mansfield ..... F02D 1/183 123/447
3,587,547 A * 6/1971 Hussey et al. ..... F02D 1/00 123/447
3,625,192 A * 12/1971 Dreisin ..... F02M 41/12 123/495
3,908,621 A * 9/1975 Hussey ..... F02M 61/205 123/447
6,431,151 B1 * 8/2002 Gmelin ..... F02M 61/14 123/468
6,799,748 B2 10/2004 Enke et al. ..... 251/362
6,938,880 B2 9/2005 Enke et al. ..... 251/362
6,994,280 B2 2/2006 Kurz et al. ..... 239/533.2

FOREIGN PATENT DOCUMENTS

DE 102006049532 A1 4/2008 ..... F02M 61/16
DE 102008042154 A1 3/2010 ..... F02M 47/02
EP 890734 A2 1/1999 ..... F02M 61/10
EP 2336548 A1 6/2011 ..... F02M 61/14
JP 01172063 A 7/1989 ..... B62D 5/07
WO 01/79689 A2 10/2001 ..... F02M 61/04
WO 2009/019178 A1 2/2009 ..... F02M 51/06
WO 2014/053375 A1 4/2014 ..... F02M 61/16

OTHER PUBLICATIONS

International Search Report and Written Opinion, Application No. PCT/EP2013/069988, 11 pages, dated Nov. 21, 2013.

* cited by examiner

NOZZLE ASSEMBLY FOR A FLUID INJECTOR AND FLUID INJECTOR

CROSS-REFERENCE TO RELATED APPLICATIONS

This application is a U.S. National Stage Application of International Application No. PCT/EP2013/069988 filed Sep. 25, 2013, which designates the United States of America, and claims priority to DE Application No. 10 2012 217 991.7 filed Oct. 2, 2012, the contents of which are hereby incorporated by reference in their entirety.

TECHNICAL FIELD

A nozzle assembly for a fluid injector and a fluid injector having a nozzle assembly are specified.

BACKGROUND

Ever more stringent legal regulations with regard to the admissible pollutant emissions and fuel consumption of internal combustion engines arranged in motor vehicles necessitate the implementation of measures for lowering pollutant emissions and fuel consumption. For example, the formation of soot and/or NOx emissions is dependent inter alia on the preparation of the air/fuel mixture in the respective cylinder of the internal combustion engine. One approach here is to attain very good preparation of the air/fuel mixture and thus reduce the pollutant emissions and fuel consumption of the internal combustion engine.

Correspondingly improved mixture preparation can be achieved if the fuel is metered at very high pressure. The fuel pressures in diesel internal combustion engines are for example up to over 2000 bar. Such high pressures place high demands on the material of the nozzle assembly, on the design thereof and also on the fuel injector as a whole. At the same time, relatively high forces must be absorbed by the nozzle assembly.

SUMMARY

One embodiment provides a nozzle assembly for a fluid injector, having a nozzle body with a central axis, wherein the nozzle body has a nozzle body recess, at least one injection opening, and an external wall facing away from the nozzle body recess, and a nozzle clamping nut by means of which the nozzle body can be coupled to an injector body, wherein the nozzle clamping nut has an internal wall facing toward the external wall of the nozzle body, wherein the nozzle body and the nozzle clamping nut are designed such that, under the action to which the nozzle body recess is subjected by a normal operating pressure of a fluid to be metered, the external wall of the nozzle body bears at least partially against the internal wall of the nozzle clamping nut in a radial direction.

In a further embodiment, an overlap region is provided in which the nozzle body overlaps the nozzle clamping nut in a radial direction, wherein the overlap region extends in an axial direction from a first end, facing away from the injection opening, to a second end, facing toward the injection opening; a first subregion of the overlap region extends in the axial direction from the first end to a contact point at which the nozzle body bears in the axial direction against the nozzle clamping nut; and under the action to which the nozzle body recess is subjected by the normal operating pressure of the fluid to be metered, the external wall of the nozzle body in the first subregion bears at least partially against the internal wall of the nozzle clamping nut in the radial direction.

In a further embodiment, an internal diameter of the nozzle clamping nut is constant in the first subregion.

In a further embodiment, at least one section of the internal wall of the nozzle clamping nut is of convex form in the first subregion.

In a further embodiment, at least one section of the external wall of the nozzle body is of convex form in the first subregion.

In a further embodiment, under the action to which the nozzle body recess is subjected by a predefined reference pressure of the fluid to be metered, a minimum spacing in the radial direction between the external wall of the nozzle body and the internal wall of the nozzle clamping nut in the first subregion is less than 0.2 mm.

In a further embodiment, under the action to which the nozzle body recess is subjected by the predefined reference pressure of the fluid to be metered, the external wall of the nozzle body and the internal wall of the nozzle clamping nut have a spacing of less than or equal to 0.1 mm throughout the first subregion.

In a further embodiment, the first subregion has a first section in which, under the action to which the nozzle body recess is subjected by the predefined reference pressure of the fluid to be metered, the spacing between the external wall of the nozzle body and the internal wall of the nozzle clamping nut is less than or equal to that in all other sections of the first subregion, wherein, in the axial direction, the first section is at least at a distance of 25% of the length of the first subregion both from the first end and from the contact point.

In a further embodiment, in the axial direction, the first section is at a distance of at least 4 mm both from the first end and from the contact point.

Another embodiment provides a fluid injector having an injector body and a nozzle assembly as disclosed above.

BRIEF DESCRIPTION OF THE DRAWINGS

Example embodiments of the invention are discussed in detail below with reference to the drawings, in which.

DETAILED DESCRIPTION

Figure 1:
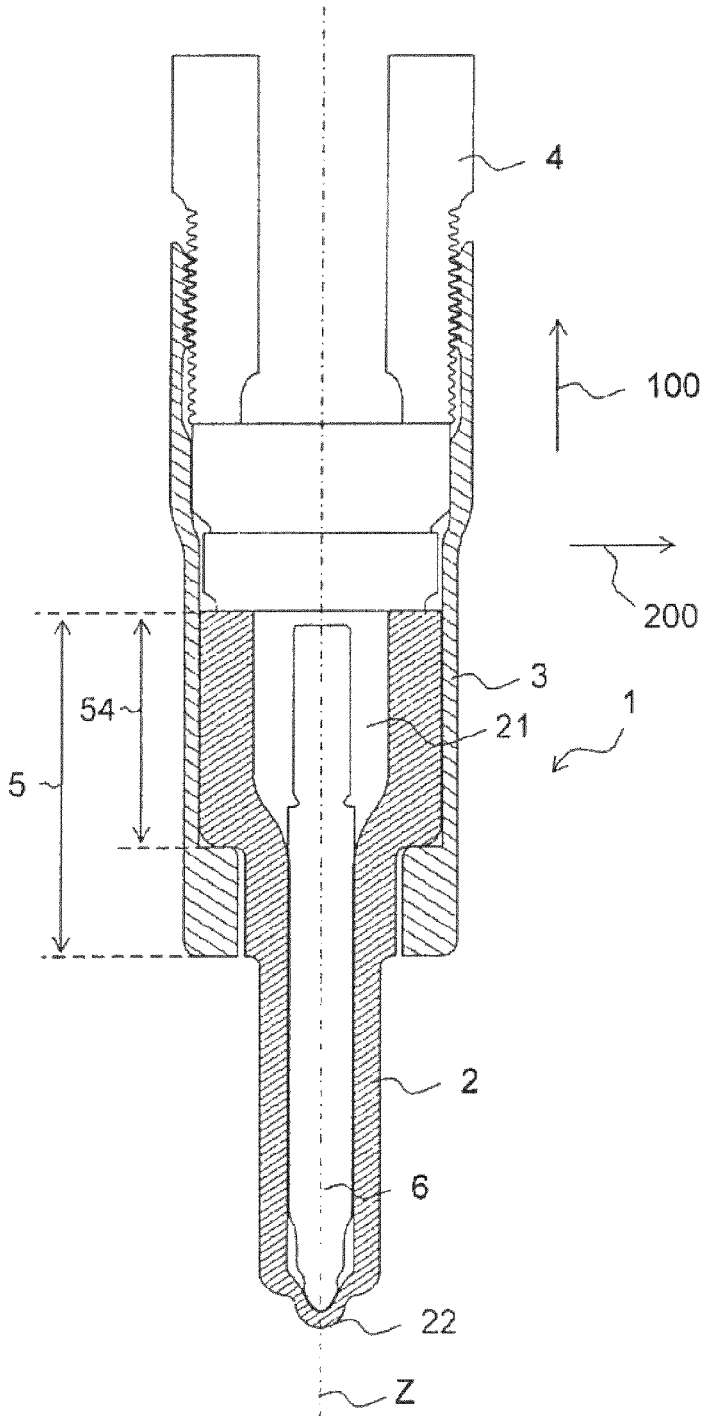
FIG. 1 shows a fluid injector in longitudinal section.

Embodiments of the invention provide a nozzle assembly for a fluid injector which permits reliable and precise operation, and a fluid injector having a nozzle assembly.

In one embodiment, the nozzle assembly for a fluid injector has a nozzle body with a central axis. The nozzle body has a nozzle body recess, which can preferably be hydraulically coupled to a high-pressure circuit of a fluid to be metered. In the nozzle body recess there is preferably arranged a nozzle needle which is axially movable, that is to say movable in the direction of the central axis, and which, in a closed position, prevents a fluid flow through an injection opening and, outside the closed position, permits a fluid flow through the injection opening. The nozzle body has an internal wall facing toward the nozzle body recess and has an external wall facing away from the nozzle body recess.

The nozzle assembly furthermore comprises a nozzle clamping nut by means of which the nozzle body can be coupled to an injector body. For example, the nozzle clamping nut and the injector body may each have a thread and thus be screwed to one another. Further components, for example intermediate plates or thrust washers, may be arranged between the nozzle body and the injector body. The nozzle clamping nut has an internal wall facing toward the external wall of the nozzle body and has an external wall facing away from the external wall of the nozzle body.

Furthermore, the nozzle body and the nozzle clamping nut are designed such that, under the action to which the nozzle body recess is subjected by a normal operating pressure of the fluid to be metered, the external wall of the nozzle body bears at least partially against the internal wall of the nozzle clamping nut in a radial direction. For example, at least one subsection of the external wall of the nozzle body is, during operation of the nozzle assembly, in contact in the radial direction with a subsection of the internal wall of the nozzle clamping nut. The normal operating pressure may for example be the operating pressure during the operation of the nozzle assembly or the fluid injector. For example, the operating pressure may be between 1600 bar and 3000 bar, in particular between 1800 bar and 2500 bar.

Owing to the abutment of the external wall of the nozzle body against the internal wall of the nozzle clamping nut and the associated support of the nozzle body against the nozzle clamping nut under pressure, the compression pulsating fatigue strength of the nozzle assembly can advantageously be increased. This advantage can be utilized to make it possible to realize a higher system pressure or to attain a reduction of the wall thicknesses at the nozzle body, resulting in a larger fuel-conducting volume and improved constancy of quantity.

In a further embodiment, the nozzle body and the nozzle clamping nut overlap one another in a radial direction, resulting in an overlap region which extends in an axial direction from a first end, facing away from the injection opening, to a second end, facing toward the injection opening. "Radial direction" is to be understood here and below to mean a direction orthogonal with respect to the axial direction or with respect to the central axis. A first subregion of the overlap region extends in the axial direction from the first end to a contact point at which the nozzle body bears against the nozzle clamping nut in the axial direction. It is preferably the case that, under the action to which the nozzle body recess is subjected by the normal operating pressure of the fluid to be metered, the external wall of the nozzle body in particular in the first subregion bears at least partially against the internal wall of the nozzle clamping nut in the radial direction.

In a further embodiment, the nozzle clamping nut has an internal diameter, wherein the internal diameter is constant in the first subregion. In other words, the internal diameter of the nozzle clamping nut does not change in the first subregion. In this way, it can advantageously be achieved that, during operation of the nozzle assembly, support between regions of the nozzle body and of the nozzle clamping nut, and a resulting increase of the compression pulsating fatigue strength, are attained in particular in a region which is sensitive with regard to the high-pressure resistance of the nozzle body.

In a further embodiment, at least one section of the internal wall of the nozzle clamping nut is of convex form in the first subregion. Thus, in the first subregion, the internal wall of the nozzle clamping nut may be curved such that regions of the internal wall of the nozzle clamping nut which lie closer to the first end or to the contact point are a greater distance from the central axis than regions of the internal wall of the nozzle clamping nut which are further remote from the first end or from the contact point. In a particularly preferred embodiment, the entire internal wall of the nozzle clamping nut is of convex form in the first subregion. By means of such a design, too, it is possible, owing to a centering action between nozzle body and nozzle clamping nut imparted by a radius in the internal wall of the nozzle clamping nut in the first subregion, to attain an increase in the compression pulsating fatigue strength of the individual components, in particular of the nozzle body.

In a further embodiment, at least one section of the external wall of the nozzle body is of convex form in the first subregion. In this case, it is preferably the case that the nozzle clamping nut has a constant diameter in the first subregion. For example, the external wall of the nozzle body in the first subregion may be curved such that regions of the external wall of the nozzle body which lie closer to the first end or to the contact point are at a greater distance from the internal wall of the nozzle clamping nut than regions of the external wall of the nozzle body which are further remote from the first end or from the contact point. In a particularly preferred embodiment, the entire external wall of the nozzle body is of convex form in the first subregion. The centering action between nozzle body and nozzle clamping nut imparted by a radius in the external wall of the nozzle body can likewise have the effect of increasing the compression pulsating fatigue strength of the components.

In a further embodiment, under the action to which the nozzle body recess is subjected by a predefined reference pressure of the fluid to be metered, a minimum spacing in the radial direction between the external wall of the nozzle body and the internal wall of the nozzle clamping nut in the first subregion is less than 0.2 mm. The predefined reference pressure may for example correspond approximately to atmospheric pressure. Thus, in the first subregion, a minimum spacing between the external wall of the nozzle body and the internal wall of the nozzle clamping nut may be less than 0.2 mm, for example in particular when the nozzle assembly is not in operation. In a further particularly preferred embodiment, under the action to which the nozzle body recess is subjected by the predefined reference pressure of the fluid to be metered, the minimum spacing in the radial direction between the external wall of the nozzle body and the internal wall of the nozzle clamping nut in the first subregion is less than or equal to 0.1 mm. By means of such a reduction of the minimum spacing between the external wall of the nozzle body and the internal wall of the nozzle clamping nut in the first subregion during the operation of the nozzle assembly, it is advantageously possible to realize support between regions of the nozzle body and of the nozzle clamping nut.

In a further embodiment, under the action to which the nozzle body recess is subjected by the predefined reference pressure of the fluid to be metered, the external wall of the nozzle body and the internal wall of the nozzle clamping nut run substantially parallel to one another in the first subregion. In this case, "substantially parallel" means that the external wall of the nozzle body and the internal wall of the nozzle clamping nut run parallel to one another, with any deviations lying only within the range of manufacturing tolerances of the individual components. In the case of such a design of the external wall of the nozzle body and of the internal wall of the nozzle clamping nut in the first subregion, it is possible, under the action to which the nozzle body recess is subjected by the normal operating pressure of the fluid to be metered, to realize contact over a large area between regions of the nozzle body and of the nozzle clamping nut owing to the centering throughout.

In a further embodiment, under the action to which the nozzle body recess is subjected by the predefined reference pressure of the fluid to be metered, the external wall of the nozzle body and the internal wall of the nozzle clamping nut have a spacing of less than or equal to 0.1 mm throughout the first subregion. Here, it is advantageously the case that the external wall of the nozzle body and the internal wall of the nozzle clamping nut run substantially parallel to one another in the first subregion, wherein the external wall of the nozzle body and the internal wall of the nozzle clamping nut may for example have a constant spacing of less than or equal to 0.1 mm to one another in the first subregion.

In a further embodiment, the first subregion has a first section in which, under the action to which the nozzle body recess is subjected by the predefined reference pressure of the fluid to be metered, the spacing between the external wall of the nozzle body and the internal wall of the nozzle clamping nut is less than or equal to that in all other sections of the first subregion. Here, it is preferably the case that, in the axial direction, the first section is at least at a distance of 25% of the length of the first subregion both from the first end and from the contact point. In this way, support between nozzle body and nozzle clamping nut can be attained in particular in regions of the nozzle body which are particularly critical with regard to high-pressure resistance.

In a further embodiment, in the axial direction, the first section is at a distance of at least 4 mm both from the first end and from the contact point. It is advantageously thus possible for targeted support to be realized in sensitive regions of the nozzle body, for example in the region of the nozzle body collar, during the operation of the fluid injector.

In a further embodiment, under the action to which the nozzle body recess is subjected by the predefined reference pressure of the fluid to be metered, the spacing between the external wall of the nozzle body and the internal wall of the nozzle clamping nut in the first section is less than that in all other sections of the first subregion. For example, owing to a centering action imparted by a radius in the internal wall of the nozzle clamping nut and/or owing to a centering action imparted by a radius in the external wall of the nozzle body, it can be achieved that a spacing in the radial direction between the external wall of the nozzle body and the internal wall of the nozzle clamping nut is smaller in the first section than in other sections of the first subregion which do not lie in the first section.

In a further embodiment, under the action to which the nozzle body recess is subjected by the normal operating pressure of the fluid to be metered, the external wall of the nozzle body lies at least partially against the internal wall of the nozzle clamping nut in particular in the first section of the first subregion. It is preferably the case that, in the axial direction, the first section is at least at a distance of 25% of the length of the first subregion both from the first end and from the contact point. In a further embodiment, in the axial direction, the first section is at a distance of at least 4 mm both from the first end and from the contact point. In this way, support between the internal wall of the nozzle clamping nut and the external wall of the nozzle body can be attained in particular in regions which are sensitive with regard to the high-pressure resistance of the nozzle body.

Owing to the expediently located radial introduction of force between nozzle clamping nut and nozzle body, radial prestressing of the nozzle body, and a reduction in the stress level, are thus realized. Furthermore, the enhanced force flux between nozzle body and nozzle clamping nut has the effect of an increase in wall thickness, thus leading to a further reduction in the stress amplitudes. In particular in the case of restrictions with regard to the wall thicknesses of the nozzle body owing to installation space conditions, it is thus possible for the compression pulsating fatigue strength of the components to be increased without cost increases that result for example from material improvements.

In at least one further embodiment, a fluid injector has a nozzle assembly and an injector body, wherein.

The fluid injector may in this case in particular comprise a nozzle assembly having one or more features of the embodiments mentioned above and of the further embodiments.

FIG. 1 shows a fluid injector having a nozzle assembly 1 and having an injector body 4. The nozzle assembly 1 has a nozzle body 2 and a nozzle clamping nut 3, wherein the nozzle body 2 is fixedly coupled to the injector body 4 by means of the nozzle clamping nut 3. The nozzle body 2 and the injector body 4 thus form a common housing of the fluid injector. Further components, for example intermediate plates or thrust washers, may be arranged between the nozzle body 2 and the injector body 4.

The nozzle body 2 has a central axis Z in a longitudinal direction. The nozzle body 2 has a nozzle body recess 21 which can be hydraulically coupled to a high-pressure circuit of a fluid to be metered. In the nozzle body recess 21 there is arranged a nozzle needle 6 which, together with the nozzle body 2 and the nozzle clamping nut 3, forms the nozzle assembly 1. The nozzle needle 6 is guided in a region of the nozzle body recess 21. Said nozzle needle is furthermore prestressed by means of spring force and/or hydraulic force so as to prevent a fluid flow through an injection opening 22 arranged in the nozzle body 2 when no further forces are acting on the nozzle needle 6. The nozzle body 2 has an internal wall 23 facing toward the nozzle body recess 21 and an external wall 24 facing away from the nozzle body recess 21.

The nozzle assembly furthermore comprises a nozzle clamping nut 3 by means of which the nozzle body 2 is coupled to the injector body 4. The nozzle clamping nut has an internal wall 31 facing toward the external wall 24 of the nozzle body 2. The nozzle body 2 and the nozzle clamping nut 3 overlap one another in a radial direction in an overlap region 5. Said overlap region 5 extends in an axial direction 100 from a first end 51, which faces away from the injection opening 22 and which forms an upper edge of the nozzle body 2, to a second end 52, which faces toward the injection opening 22. A first subregion 54 of the overlap region 5 extends in the axial direction 100 from the first end 51 to a contact point 53 at which the nozzle body 2 bears in the axial direction 100 against the nozzle clamping nut 3.

Figure 2:
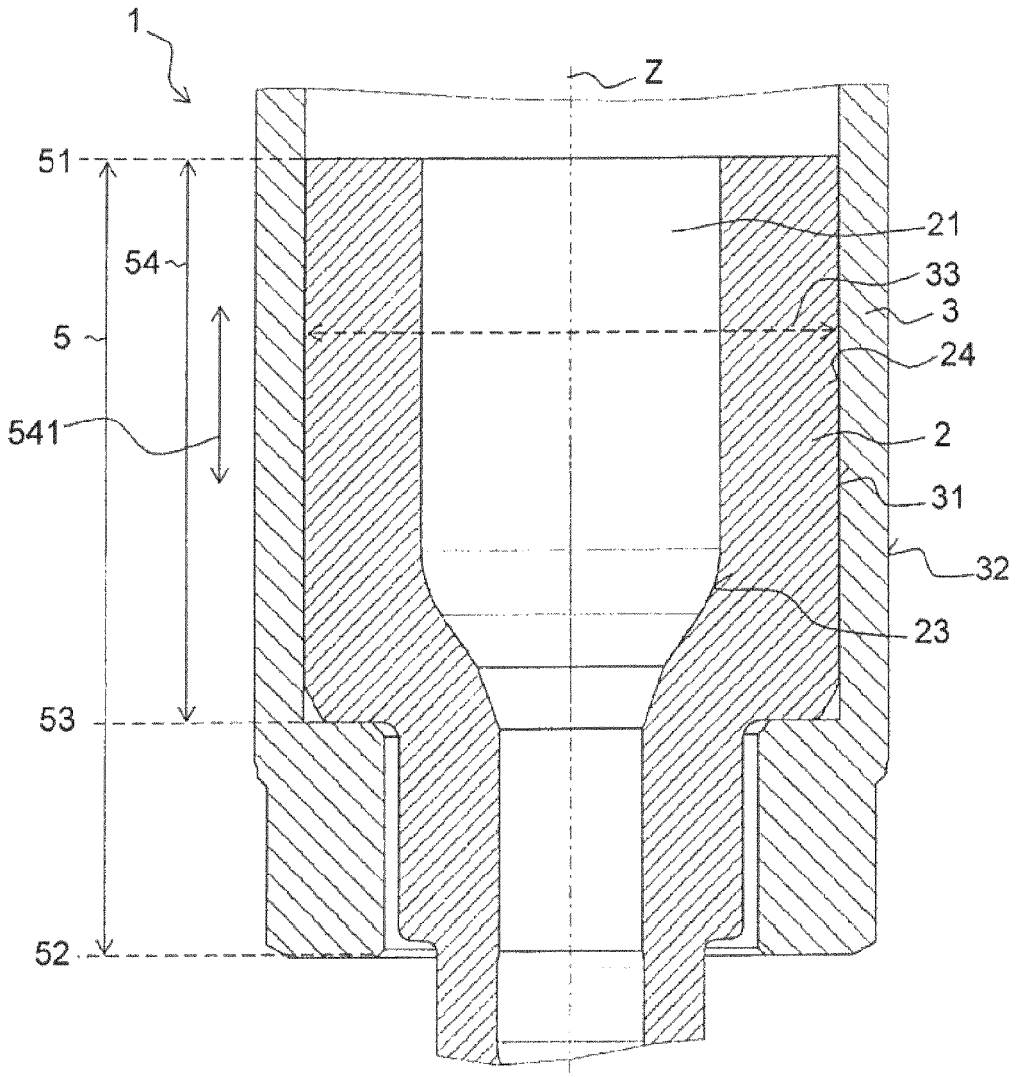
FIG. 2 is an enlarged illustration of a detail from FIG. 1 according to one exemplary embodiment.

FIG. 2 is an enlarged illustration of a detail from FIG. 1 according to a first exemplary embodiment. The nozzle clamping nut 3 has an internal diameter 33 which is constant in the first subregion 54. It is preferably the case that, under the action to which the nozzle body recess 21 is subjected by a predefined reference pressure of the fluid to be metered, a minimum spacing between the external wall 24 of the nozzle body 2 and the internal wall 31 of the nozzle clamping nut 3 in the subregion 54 is less than 0.2 mm. In this case, the predefined reference pressure approximately corresponds, for example, to atmospheric pressure. It is particularly preferably the case that, under the action to which the nozzle body recess 21 is subjected by the predefined reference pressure of the fluid to be metered, the minimum spacing in a radial direction 200 between the external wall 24 of the nozzle body 2 and the internal wall 31 of the nozzle clamping nut 3 in the first subregion 54 is less than or equal to 0.1 mm.

The nozzle body 2 and the nozzle clamping nut 3 are designed such that, under the action to which the nozzle body recess 21 is subjected by a normal operating pressure of the fluid to be metered, the external wall 24 of the nozzle body 2 bears at least partially against the internal wall 31 of the nozzle clamping nut 3 in the radial direction 200. The normal operating pressure may for example be the operating pressure during the operation of the fluid injector. For example, the operating pressure may lie between 1600 bar and 3000 bar, in particular between 1800 bar and 2500 bar. Owing to the abutment of the external wall 24 of the nozzle body 2 against the internal wall 31 of the nozzle clamping nut 3, and the associated support of the nozzle body 2 against the nozzle clamping nut 3 under pressure, it is advantageously possible for the compression pulsating fatigue stress of the nozzle assembly 1 to be increased. For example, during operation of the nozzle assembly 1, encircling support between regions of the nozzle body 2 and of the nozzle clamping nut 3, and a resulting increase of the compression pulsating fatigue strength, can be attained in the first subregion 54.

The external wall 24 of the nozzle body 2 and the internal wall 31 of the nozzle clamping nut 3 run substantially parallel to one another in the first subregion 54. It is for example the case that, under the action to which the nozzle body recess 21 is subjected by the predefined reference pressure of the fluid to be metered, the external wall of the nozzle body 2 and the internal wall 31 of the nozzle clamping nut 3 have, in the first subregion, a substantially constant spacing of less than 0.2 mm, particularly preferably of less than or equal to 0.1 mm.

For example, the first subregion 54 has a first section 541 in which, under the action to which the nozzle body recess 21 is subjected by the normal operating pressure of the fluid to be metered, the external wall 24 of the nozzle body 2 bears against the internal wall 31 of the nozzle clamping nut 3, wherein, in the axial direction 100, the first section 541 is at least at a distance of 25% of the length of the first subregion 54 both from the first end 51 and from the contact point 53. It may for example be the case that, in the axial direction 100, the first section 541 is at a distance of at least 4 mm both from the first end 51 and from the contact point 53. In this way, support can be realized in particular in regions which are critical with regard to the compression pulsating fatigue strength of the nozzle body 2.

Figure 3:
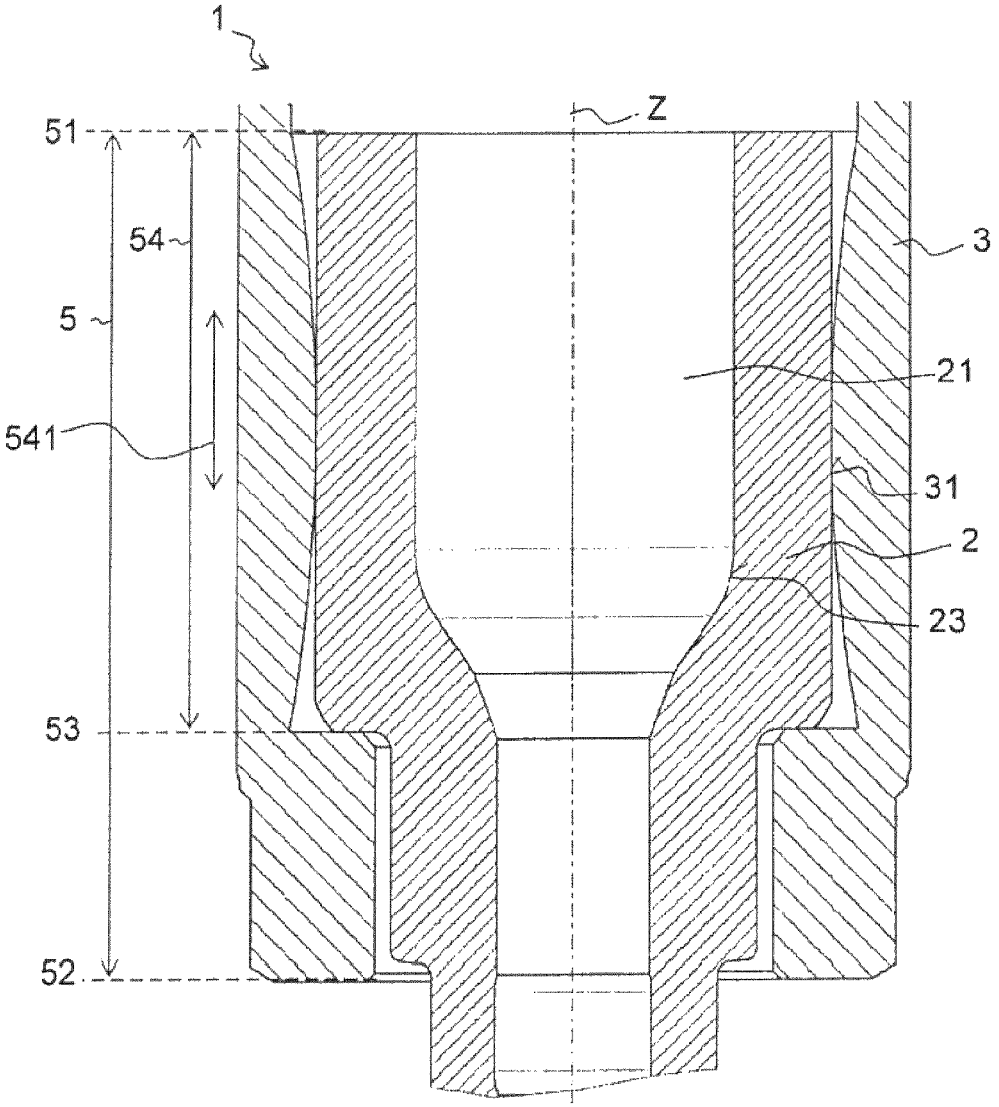
FIG. 3 is an enlarged illustration of a detail from FIG. 1 according to a further exemplary embodiment.

FIG. 3 is an enlarged illustration of a detail from FIG. 1 according to a further exemplary embodiment. In this case, the internal wall 31 of the nozzle clamping nut 3 is of convex form in the first subregion 54. The first subregion 54 preferably has a first section 541 in which, under the action to which the nozzle body recess 21 is subjected by the predefined reference pressure of the fluid to be metered, the spacing between the external wall 24 of the nozzle body 2 and the internal wall 31 of the nozzle clamping nut 3 is smaller than that in all other sections of the first subregion 54, wherein, in the axial direction 100, the first section 541 is at least at a distance of 25% of the length of the first subregion 54 both from the first end 51 and from the contact point 53. For example, in the axial direction 100, the first section 541 may be at a distance of at least 4 mm both from the first end 51 and from the contact point 51.

It is preferably the case that, under the action to which the nozzle body recess 21 is subjected by the predefined reference pressure of the fluid to be metered, the spacing between the external wall 24 of the nozzle body 2 and the internal wall 31 of the nozzle clamping nut 3 in the first section 541 is less than 0.2 mm. During the operation of the fluid injector, that is to say under the action to which the nozzle body recess 21 is subjected by the normal operating pressure of the fluid to be metered, the external wall 24 of the nozzle body 2 bears at least partially against the internal wall 31 of the nozzle clamping nut 3, such that, owing to the centering action imparted by the radius in the internal wall 23 of the nozzle clamping nut 3, support of the nozzle body 2 is realized in said region.

Figure 4:
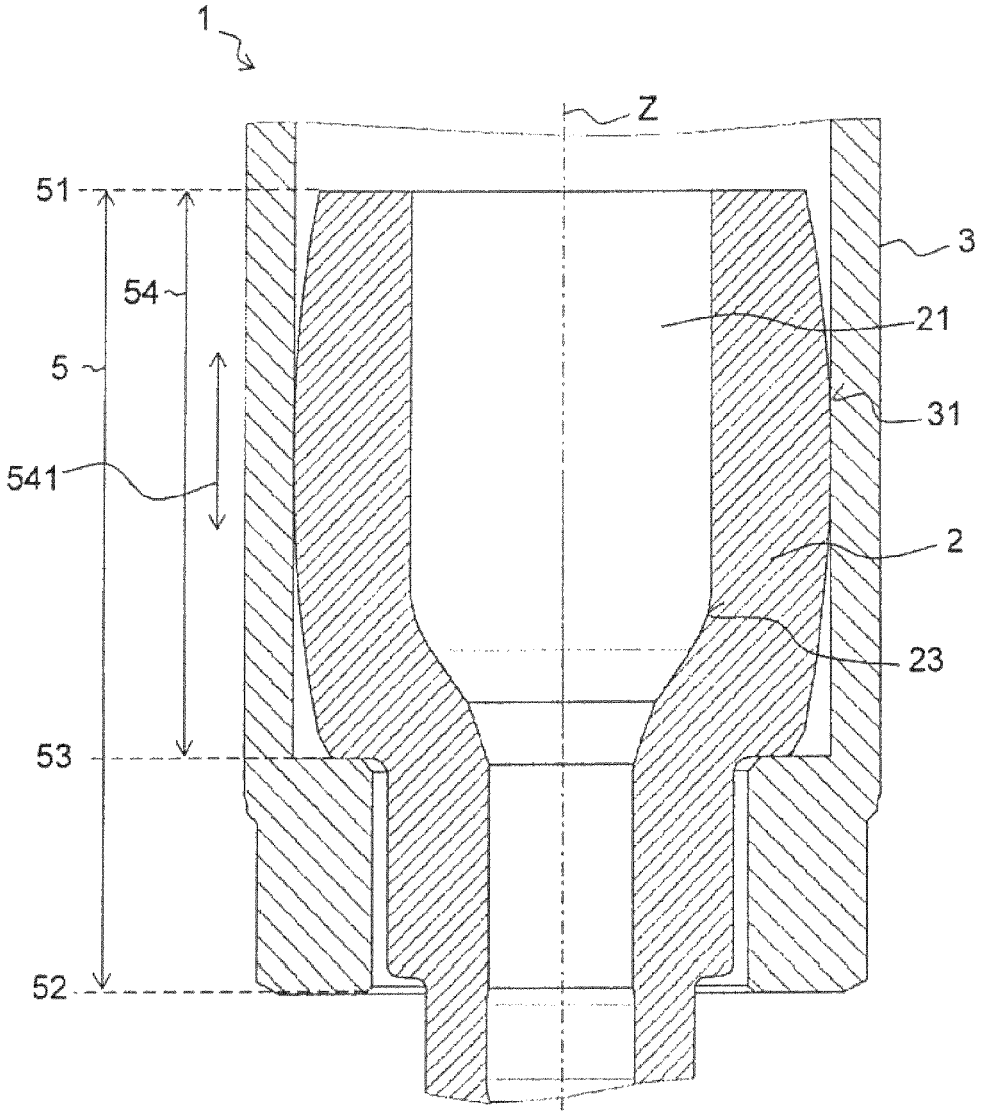
FIG. 4 is an enlarged illustration of a detail from FIG. 1 according to a further exemplary embodiment.

FIG. 4 is an enlarged illustration of a detail from FIG. 1 according to a further exemplary embodiment. By contrast to the exemplary embodiment shown in FIG. 2, the external wall 24 of the nozzle body 2 is of convex form in the first subregion 54. It is preferably the case that, under the action to which the nozzle body recess 21 is subjected by the predefined reference pressure of the fluid to be metered, the minimum spacing in the radial direction 200 between the external wall 24 of the nozzle body 2 and the internal wall 31 of the nozzle clamping nut 3 in the first subregion 54 is less than or equal to 0.1 mm. It is also the case in the exemplary embodiment shown in FIG. 4 that, during operation of the fluid injector, support of the nozzle body 2 can be realized by virtue of regions of the external wall 24 of the nozzle body 2 abutting against the internal wall 31 of the nozzle clamping nut 3 in the first subregion.

The exemplary embodiments shown in figures may alternatively or additionally have further features according to the embodiments of the general description.

What is claimed is:

1. A nozzle assembly for a fluid injector, comprising:

a nozzle body with a central axis, wherein the nozzle body comprises a nozzle body recess, an injection opening, and an external wall facing away from the nozzle body recess, and a nozzle clamping nut configured for coupling the nozzle body to an injector body, wherein the nozzle clamping nut has an internal wall facing toward the external wall of the nozzle body, wherein, when assembled and without an operating pressure present inside the nozzle body recess, the nozzle assembly has a first subregion of the external wall having a convex form extending along a longitudinal length of the nozzle body, wherein the convex form of the first subregion defines a convex curve in a longitudinal plane extending through the external wall and along the longitudinal length of the nozzle body, wherein a first section of the convex form first subregion of the external wall of the nozzle body, in the middle of the longitudinal length, abuts against the internal wall of the nozzle clamping nut under forces imposed on the nozzle body recess by a normal operating pressure of a fluid to be metered, so the external wall of the nozzle body bears at least partially against the internal wall of the nozzle clamping nut in a radial direction, and a section of the convex form first subregion other than the first section, on either extremity of the longitudinal length, is farther away from the internal wall of the nozzle clamping nut without the operating pressure present inside the nozzle body recess, wherein an internal diameter of the nozzle clamping nut is constant in the first subregion.

2. The nozzle assembly of claim 1, wherein, under forces imposed on the nozzle body recess by a predefined reference pressure of the fluid to be metered, a minimum spacing in the radial direction between the external wall of the nozzle body and the internal wall of the nozzle clamping nut in the first subregion is less than 0.2 mm.

3. The nozzle assembly of claim 2, wherein, under forces imposed on the nozzle body recess by the predefined reference pressure of the fluid to be metered, the external wall of the nozzle body and the internal wall of the nozzle clamping nut have a spacing of less than or equal to 0.1 mm throughout the first subregion.

4. A fluid injector comprising:

an injector body; and a nozzle assembly coupled to the injector body and comprising:

a nozzle body with a central axis, wherein the nozzle body comprises a nozzle body recess, an injection opening, and an external wall facing away from the nozzle body recess, and a nozzle clamping nut configured for coupling the nozzle body to an injector body, wherein the nozzle clamping nut has an internal wall facing toward the external wall of the nozzle body, and wherein, when assembled and without an operating pressure present inside the nozzle body recess, the nozzle assembly has a first subregion of the external wall having a convex form extending along a longitudinal length of the nozzle body, wherein the convex form of the first subregion defines a convex curve in a longitudinal plane extending through the external wall and along the longitudinal length of the nozzle body, and wherein a first section of the convex form first subregion of the external wall of the nozzle body, in the middle of the longitudinal length, abuts against the internal wall of the nozzle clamping nut under forces imposed on the nozzle body recess by a normal operating pressure of a fluid to be metered, so the external wall of the nozzle body bears at least partially against the internal wall of the nozzle clamping nut in a radial direction, and a section of the convex form first subregion other than the first section, on either extremity of the longitudinal length, is farther away from the internal wall of the nozzle clamping nut without the operating pressure present inside the nozzle body recess, wherein an internal diameter of the nozzle clamping nut is constant in the first subregion.

5. The fluid injector of claim 4, wherein, under forces imposed on the nozzle body recess by a predefined reference pressure of the fluid to be metered, a minimum spacing in the radial direction between the external wall of the nozzle body and the internal wall of the nozzle clamping nut in the first subregion is less than 0.2 mm.

6. The fluid injector of claim 5, wherein, under forces imposed on the nozzle body recess by the predefined reference pressure of the fluid to be metered, the external wall of the nozzle body and the internal wall of the nozzle clamping nut have a spacing of less than or equal to 0.1 mm throughout the first subregion.

* * * * *